US006367769B1

(12) United States Patent
Reiter

(10) Patent No.: US 6,367,769 B1
(45) Date of Patent: Apr. 9, 2002

(54) FUEL INJECTION VALVE

(75) Inventor: Ferdinand Reiter, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/582,455

(22) PCT Filed: Jul. 20, 1999

(86) PCT No.: PCT/DE99/02229

§ 371 Date: Aug. 31, 2000

§ 102(e) Date: Aug. 31, 2000

(87) PCT Pub. No.: WO00/25018

PCT Pub. Date: May 4, 2000

(30) Foreign Application Priority Data

Oct. 26, 1998 (DE) ..... 198 49 210

(51) Int. Cl.[7] ..... F02M 51/06

(52) U.S. Cl. ..... 251/129.19; 251/129.15; 251/337; 239/585.5; 335/257

(58) Field of Search ..... 251/64, 129.19, 251/129.21, 337, 129.15; 239/585.5, 585.3; 335/257, 277

(56) References Cited

U.S. PATENT DOCUMENTS

| | | | | |
|---|---|---|---|---|
| 4,763,091 A | * | 8/1988 | Lang | 335/258 |
| 4,766,405 A | | 8/1988 | Daly | |
| 5,029,807 A | * | 7/1991 | Fuchs | 251/129.19 X |
| 5,114,077 A | | 5/1992 | Cerny | |
| 5,236,173 A | | 8/1993 | Wakeman | |
| 5,299,776 A | | 4/1994 | Brinn | |
| 5,645,019 A | * | 7/1997 | Liang et al. | 123/90.11 |
| 5,961,097 A | * | 10/1999 | Zimmermann | 251/129.19 |

* cited by examiner

*Primary Examiner*—John Kwon
*Assistant Examiner*—Eric Keasel
(74) *Attorney, Agent, or Firm*—Kenyon & Kenyon

(57) ABSTRACT

A fuel injection valve for a fuel injection system of an internal combustion engine includes a magnetic coil, an armature loadable by the magnetic coil against a resetting spring in the lifting direction, and a valve needle connected to a valve closing member. The armature is movable between a first stop connected to the valve needle and limiting the movement of the armature in the lifting direction and a second stop connected to the valve needle and limiting the movement of the armature against the lifting direction. A damping spring, which may be a cup spring, is provided between the second stop and the armature.

13 Claims, 3 Drawing Sheets

FUEL INJECTION VALVE

FIELD OF THE INVENTION

The present invention relates to a fuel injection valve.

BACKGROUND INFORMATION

In U.S. Pat. No. 5,299,776 is discussed a fuel injection valve that has a valve closing member that is connected to a valve needle and interacts with a valve seat surface provided on a valve seat body to form a sealed seat. A magnetic coil, which interacts with an armature that moves on the valve needle between a first stop limiting the armature movement in the lifting direction of the valve needle and a second stop limiting the armature movement against the lifting direction, is provided for the electromagnetic operation of the fuel injection valve. Within certain limits, the axial armature clearance defined between the two stops isolates the inert mass of the valve needle and the valve closing member and the inert mass of the armature. This counteracts a rebounding of the valve closing member from the valve closing surface within certain limits when the fuel injection valve closes. It is believed that bounce pulses of the valve needle and valve closing member, respectively, cause the fuel injection valve to open briefly in an uncontrolled manner, making it impossible or impractical to reproduce the metered amount of fuel and resulting in an uncontrolled injection. However, since the axial position of the armature in relation to the valve needle is completely undefined due to the free movement of the armature in relation to the valve needle, bounce pulses can be avoided only to a limited extent. Accordingly, it is believed that it is not possible or practical to prevent the armature from striking the stop facing the valve closing member while the fuel injection valve closes, abruptly transmitting its pulse to the valve needle and thus also to the valve closing member. This abrupt pulse transfer can produce additional bounce pulses of the valve closing member.

In U.S. Pat. No. 4,766,405 is discussed a method for dampening the force of the armature striking the stop facing the valve closing member. In particular, a damping member made of an elastomeric material, such as rubber, is placed between the armature and the stop. However, it is believed that, elastomeric materials have the disadvantage that their damping performance depend on temperature, and the damping effect decreases as the temperature rises. In addition, it is believed that elastomeric materials have a limited long-term stability, particularly when they come into contact with the fuel injected by the fuel injection valve. Elastomeric material aging can limit the service life of the fuel injection valve. Mounting a damping plate made of an elastomeric material may be is complicated. Vulcanizing the elastomeric material onto the armature or stop maybe equally complicated. In addition, it is not believed to be possible or practical to selectively adjust the damping characteristics.

The provision of a damping spring in the form of a cup spring between the valve seat body and a valve seat carrier, on which the valve seat body is mounted, thereby causing the valve closing member to come to rest gently against the valve seat surface provided on the valve seat body, is discussed in U.S. Pat. No. 5,236,173. It is believed however, that this damping method has the disadvantage that the valve seat body swings back in the direction of injection after the valve closing member comes to a stop, while the valve closing member either remains stationary or even moves away from the valve seat body against the direction of injection as a result of pulse reversal. Valve bounce pulses can therefore occur with even greater intensity in this fuel injection valve design, which is why this damping method may not have widely accepted.

SUMMARY OF THE INVENTION

The fuel injection valve according to an exemplary embodiment of the present invention is believed to have on advantage over the related art since the fuel injection valve is satisfactorily debounced. It is also believed to have a high long-term stability, since the damping spring has a longer service life than does an elastomeric material and, in particular, does not disintegrate over time when exposed to fuel. Compared to an elastomeric material, the damping spring is also relatively easy to install, and the damping effect is not dependent on temperature. It is also possible to selectively adjust the damping characteristics by selecting a suitable material and shape for the damping spring as well as the setting angle of the damping spring in relation to the stop and the armature, and choosing the damping spring pretension.

The fuel located in the gap between the armature and the stop flows in a compressed stream between the armature and the stop. This compressed flow results in further damping.

The damping spring may be a cup spring that surrounds the valve needle in the shape of a ring. The cup spring forms a compact damping component that can be integrated into the gap between the armature and the stop. The cup spring is also extremely easy to install; it only needs to be pushed onto the valve needle before mounting the armature.

The stop is advantageously convex, while the opposite end face of the armature can be designed with a correspondingly concave shape or, conversely, the stop can have a concave shape and the opposite end face of the armature a convex shape. This causes the gap between the armature and the stop to slope toward the longitudinal axis of the valve needle, improving the damping action through the compressed fuel flow. In addition, a cup spring having a flat spring washer, which is easy and economical to produce, can be used if the stop and opposite end face of the armature are designed with a convex and concave shape, respectively. In addition to the flat spring washer, the cup spring can also have a conical or domed spring washer, thus improving the damping effect even further.

Alternatively, it is possible to give the stop and opposite end face of the armature a flat design, in which case a cup spring with a conical or domed spring washer is used. It is even possible to use two conical or domed spring washers that are arranged consecutively in the axial direction so that either their convex sides or their concave sides are facing one another. The two spring washers can be interconnected by a connecting strap, making them easier to mount. The two spring washers can also be produced, for example, by punching them from a continuous strip of sheet metal.

To adjust the damping characteristics of the cup spring, the spring washers can have openings that influence the spring rigidity of the spring washers and also affect the compressed flow of fuel in the gap between the armature and the stop.

A further damping spring can be provided between the stop limiting the movement of the armature in the lifting direction and the armature to prevent the armature from striking this stop too forcefully and producing valve bounce pulses.

DETAILED DESCRIPTION

Figure 1:
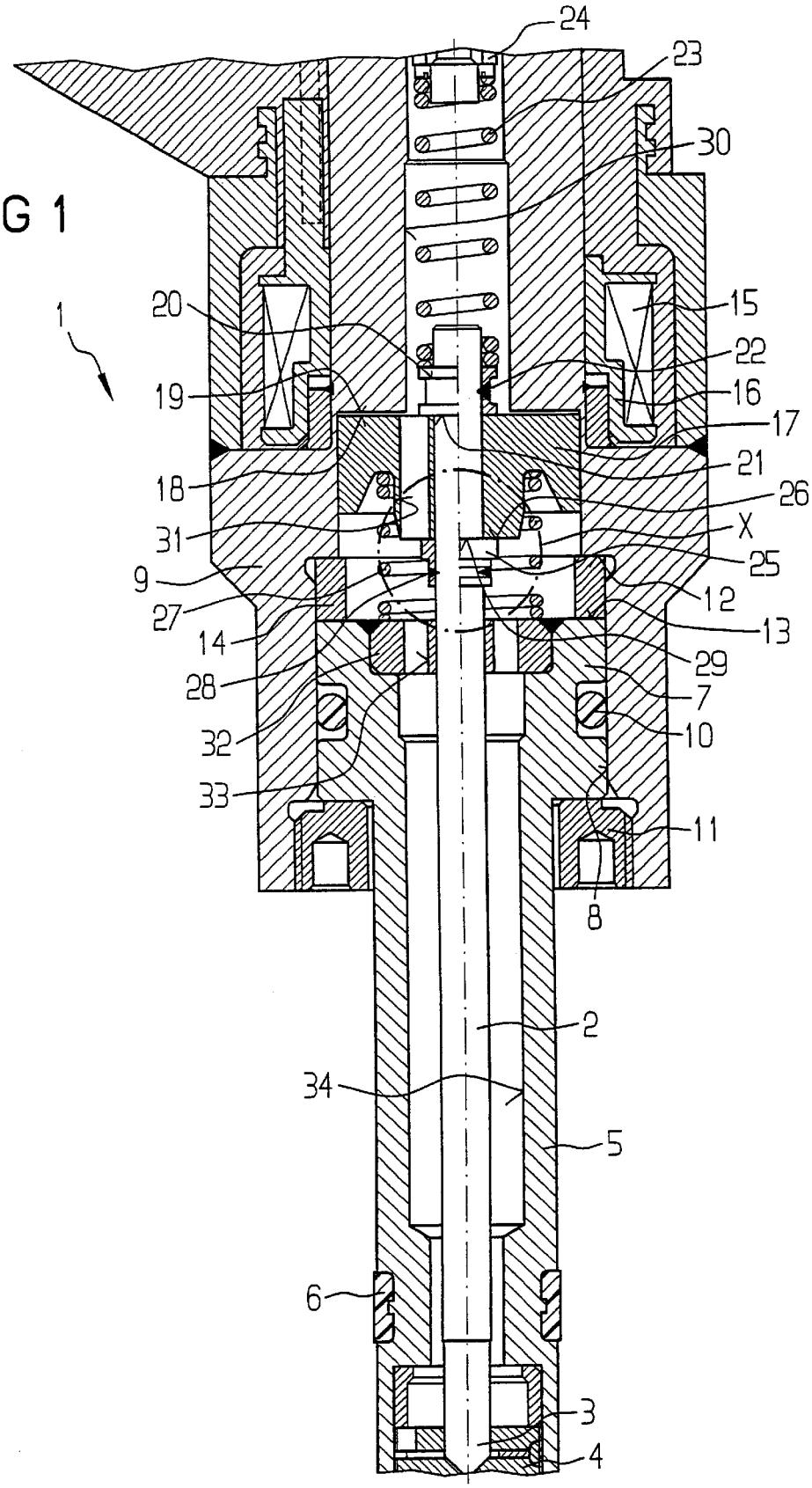
FIG. 1 shows a cross-sectional representation of a fuel injection valve according to an exemplary embodiment of the present invention.

FIG. 1 shows a cross-sectional representation of an exemplary embodiment of a fuel injection valve 1 according to the present invention. Fuel injection valve 1 is used to inject fuel in a mixture-compressing internal combustion engine with externally supplied ignition. The exemplary embodiment is a high-pressure injection valve for the direct injection of fuel, in particular, gasoline, into the combustion chamber of the internal combustion engine.

Fuel injection valve 1 has a valve closing member 3, which, in the exemplary embodiment, forms one piece with a valve needle 2 and interacts with a valve seat surface provided on a valve seat body 4, forming a sealed seat. Valve seat body 4 is connected to a tubular valve seat carrier 5, which can slide into a location hole in a cylinder head of the internal combustion engine and is sealed against the location hole by a seal 6. Intake end 7 of valve seat carrier 5 is inserted into a longitudinal hole 8 of a housing body 9 and sealed against housing body 9 by a gasket 10. Intake end 7 of valve seat carrier 5 is preloaded by a threaded ring 11, with a lift adjustment wheel 14 being clamped between a step 12 of housing body 9 and an end face 13 of intake end 7 of valve seat carrier 5.

A magnetic coil 15 that is wound onto a coil insulating frame 16 is used for the electromagnetic operation of fuel injection valve 1. Upon the electrical excitation of magnetic coil 15, an armature 17 is drawn upward in FIG. 1 until its intake end face 19 comes to rest against a step 18 of housing body 9. The width of the gap between upstream end face 19 of armature 17 and step 18 of housing body 9 determines the valve lift of fuel injection valve 1. Since the upstream end face 19 of armature 17 rests against a first stop 21 that forms a first stop member 20, armature 17 carries valve needle 2 connected to first stop member 20 and valve closing member 3 movement. Valve needle 2 is welded to first stop member 20 by a welded seam 22. Valve needle 2 moves against a resetting spring 23, which is clamped between an adjusting sleeve 24 and first stop member 20.

The fuel flows through an axial hole 30 in housing body 9 and through an axial hole 31 provided in armature 17 as well as through axial holes 33 provided in a guide disk 32 into an axial hole 34 in valve seat carrier 5, from where it reaches the sealed seat (not illustrated) of fuel injection valve 1.

Armature 17 can move between first stop 21 of first stop member 20 and a second stop 26 provided on a second stop member 25, with armature 17 being held in place against first stop 21 by a contact spring 27 in the idle position, producing a gap between armature 17 and second stop 26, thus giving armature 17 a certain amount of clearance. Second stop member 25 is attached to valve needle 2 by a welded seam 28.

The clearance of armature 17 provided between stops 21 and 26 isolates the inert masses of armature 17 on the one hand, and valve needle 2 and valve closing member 3 on the other. As fuel injection valve 1 closes, only the inert mass of valve closing member 3 and valve needle 2 is therefore applied to the valve seat surface (not illustrated), and armature 17 is not abruptly delayed when valve closing member 3 strikes the valve closing surface, but instead continues to move in the direction of second stop 26. Isolating armature 17 from valve needle 2 improves the dynamics of fuel injection valve 1. However, it is necessary to ensure that the striking action of injecting end face 29 of armature 17 against second stop 26 does not produce any valve bounce pulses. This is achieved through the features according to an exemplary embodiment the present invention.

Figure 2:
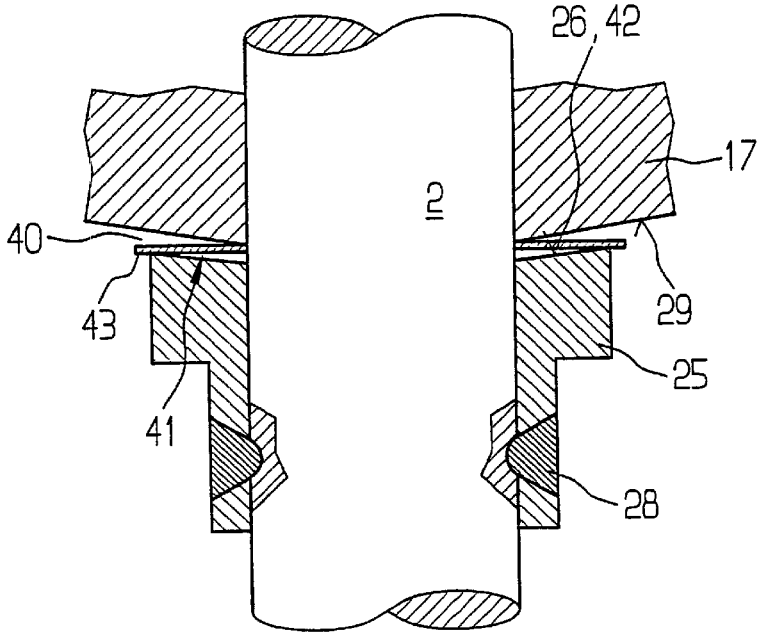
FIG. 2 shows an enlarged representation of area X in FIG. 1.

FIG. 2 shows an enlarged extract of the area marked X in FIG. 1, in which the elements already described are provided with the same reference numbers.

FIG. 2 shows valve needle 2; second stop member 25, which is welded onto valve needle 2 by welded seam 28 and includes second stop 26; armature 17 and its injecting end face 29 opposite second stop 26; and gap 40 provided between injecting end face 29 of armature 17 and stop 26 of second stop member 25 when fuel injection valve 1 is in the idle position. According to the exemplary embodiment of the present invention, a damping spring, which in the exemplary embodiment is designed as a ring-shaped cup spring 41 surrounding valve needle 2, is provided in gap 40 between second stop 26 and injecting end face 29 of armature 17.

In the exemplary embodiment shown in FIG. 2, injecting end face 29 of armature 17 is designed with a conically convex shape, while an end face 42 of second stop member 25 forming stop 26 has a conically convex shape. Alternatively, end faces 29 and 42 could also have domed convex and concave shapes. End face 29 could also be concave if, conversely, end face 42 of second stop member 25 has a convex shape. The convex and concave designs of end faces 29 and 42 make it possible to use a cup spring 41 with a flat spring washer 43.

Damping spring 41 dampens armature 17 as it strikes second stop 26, so that armature 17 strikes second stop 26 in a relatively gentle and cushioned manner. The damping effect is produced by the elastic deformation of cup spring 41 as well as by the fact that fuel enclosed in gap 40 when fuel injection valve 1 is in the idle state is forced out of gap 40, thereby compressing the flow of fuel and helping to dampen the armature movement.

If cup spring 41 not only dampens the striking action of armature 17 against second stop 26, but also preloads armature 17 until armature 17 comes to rest flush against first stop 22, contact spring 27 may be omitted.

Figure 3:
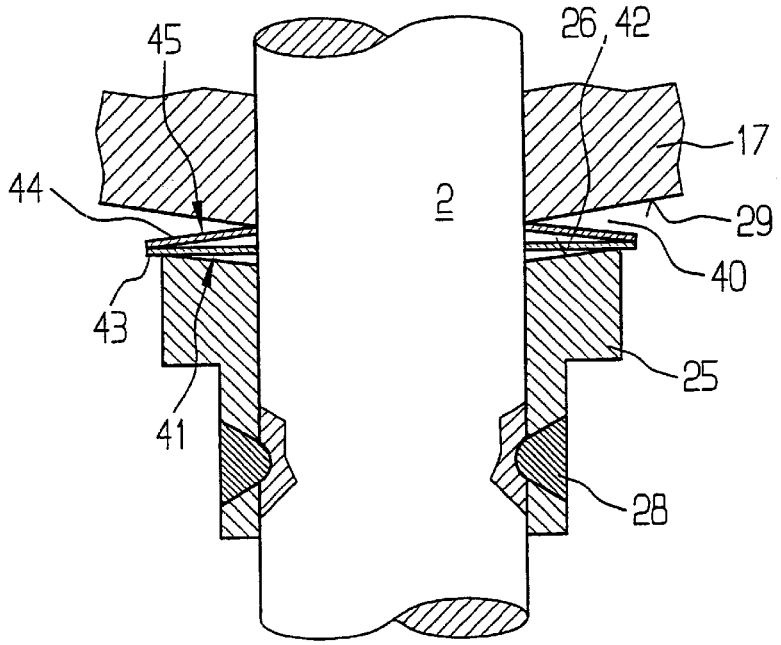
FIG. 3 shows the area X in FIG. 1 according to another exemplary embodiment.

FIG. 3 also shows the section of fuel injection valve 1 marked X in FIG. 1, but according to another exemplary embodiment.

A difference between the embodiment in FIG. 3 and the one in FIG. 2 is that cup spring 41 includes not only flat spring washer 43, but also an additional conical spring washer 44. Both spring washers 43 and 44 surround valve needle 2 in the shape of a ring. Second spring washer 44 can also have a domed shape. A convex side 45 of conical or domed spring washer 44 faces convex end face 29 of armature 17. If end face 42 of second stop member 25, and not end face 29 of armature 17, were to be designed with a convex shape, this conical or domed spring washer 44 would thus face this convex end face 42 of second stop member 25. The two-washer design of cup spring 41 causes armature 17 to come into contact with cup spring 41 at an earlier point in its downward movement, allowing the armature movement to be damped, i.e. cushioned, over a longer distance traveled by armature 17, which results in an even gentler striking action.

Figure 4:
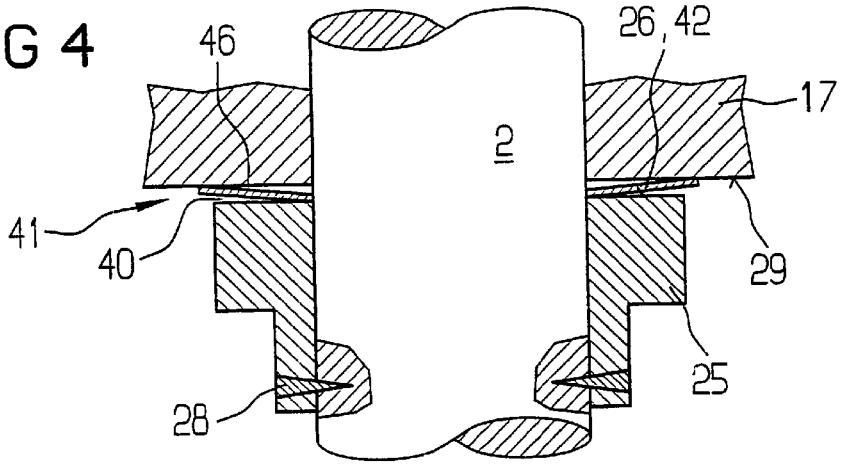
FIG. 4 shows the area X in FIG. 1 according to still another exemplary embodiment.

FIG. 4 shows the section of fuel injection valve 1 marked X in FIG. 1 according to still another exemplary embodiment.

In the embodiment shown in FIG. 4, both injecting end face 29 of armature 17 opposite second stop member 25 and end face 42 of second stop member 25 opposite armature 17 have a flat shape, a form that is easier to manufacture. Accordingly, a spring washer 45 of cup spring 41 is designed with either a conical or domed shape so that spring washer 45 engages with end face 25 of armature 17 before armature 17 strikes second stop 26.

Figure 5:
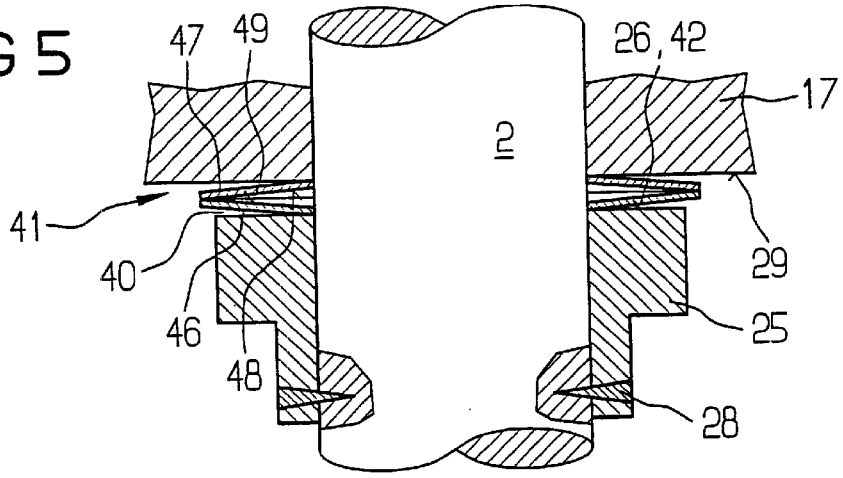
FIG. 5 shows the area X in FIG. 1 according to yet another exemplary embodiment.
Figure 6:
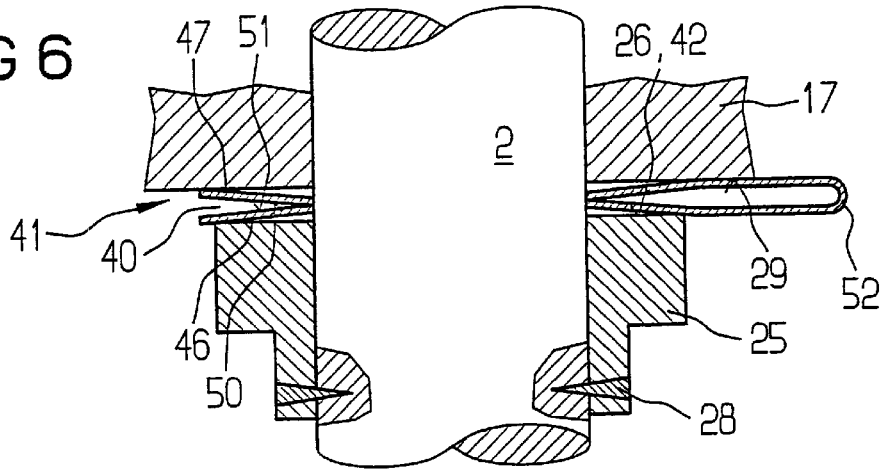
FIG. 6 shows the area X in FIG. 1 according to still another exemplary embodiment.

FIG. 5 shows an enlarged extract of the area marked X in FIG. 1 according to yet another exemplary embodiment. A difference between the embodiment in FIG. 5 and the one in FIG. 4 is that cup spring 41 includes not only a first conical or domed spring washer 46, but also a second conical or domed spring washer 47. Both conical or domed spring washers 46 and 47 are arranged consecutively in the axial direction so that concave sides 48 and 49 of spring washers 46 and 47 are facing each other. Alternatively, the exemplary embodiment shown on the left side of FIG. 6 shows both conical or domed spring washers 46 and 47 arranged consecutively in the axial direction so that convex sides 50 and 51 of spring washers 46 and 47 are facing each other. In the exemplary embodiments illustrated in FIGS. 5 and 6, the axial distance over which cup spring 41 comes to rest against injecting end face 29 of armature 17 during the downward movement of armature 17 is increased, thus also increasing the damping distance. This is believed to provide a much gentler striking action of armature 17 against second stop 26. The exemplary embodiment illustrated on the right side in FIG. 6 further differs from the exemplary embodiment shown in FIG. 5 in that both spring washers 46 and 47 are interconnected by a connecting strap 52. This makes it easier to mount cup spring 41. In addition, both spring washers 46 and 47 can be made from a single strip of sheet metal, for example, by punching, in which case two rings forming spring washers 46 and 47 are punched and interconnected by a web forming connecting strap 52.

Cup spring 41 is preferably made of a rust-resistant spring material, for example an iron and/or copper alloy. The damping characteristics of cup spring 41 can be selectively adjusted by changing the thickness and setting angle of spring washers 43, 44, 46, 47. The damping characteristics can also be varied by openings provided in spring washers 43, 44, 46, 47. These openings simultaneously influence the cross-flow of the fuel forced out of gap 40, so that this also produces a variation in damping characteristics. Cup spring 41 is mounted with a defined pretension between armature 17 and second stop member 25.

What is claimed is:

1. A fuel injection valve for a fuel injection system of an internal combustion engine, the fuel injection valve comprising:

a resetting spring;

a valve closing member; a magnetic coil;

an armature loadable by the magnetic coil against the resetting spring in a;

lifting direction;

a valve needle connected to the valve closing member, wherein the armature is movable between a first stop, connected to the valve needle and limiting a movement of the armature in the lifting direction, and a second stop, connected to the valve needle and limiting another movement of the armature against the lifting direction, wherein the second stop is formed by a first end face of a stop member opposite the armature, and includes one of:

(a) a second end face of the armature opposite the second stop having a convex shape, and a third end face of the stop member opposite the armature having a concave shape; and (b) the second end face of the armature opposite the second stop having the concave shape, and the third end face of the stop member opposite the armature having the convex shape; and a damping spring between the second stop and the armature.

2. The fuel injection valve of claim 1, wherein the damping spring is a cup spring which includes a flat spring washer.

3. The fuel injection valve of claim 1, wherein the damping spring is a cup spring which includes one of a conical spring washer and a domed spring washer, a convex side of the one of the conical spring washer and the domed spring washer facing a convex end face of the armature and another convex end face of the stop member.

4. The fuel injection valve of claim 1, further comprising another damping spring between the first stop and the armature.

5. The fuel injection valve of claim 1, wherein the damping spring includes a cup spring surrounding the valve needle in a ring shape.

6. The fuel injection valve of claim 5, wherein the damping spring includes an opening.

7. The fuel injection valve of claim 5, wherein:

the second stop is formed by an end face of a stop member opposite the armature;

another end face of the armature opposite the second stop and the end face of the stop member opposite the armature each include a flat section; and the cup spring includes one of a conical spring washer and a domed spring washer.

8. The fuel injection valve of claim 7, wherein the cup spring includes one of another conical spring washer and another domed spring washer.

9. The fuel injection valve of claim 8, wherein the one of the conical spring washer and the domed spring washer and the one of the another conical spring washer and the another domed spring washer are arranged consecutively in an axial direction so that respective concave sides thereof face one another.

10. The fuel injection valve of claim 8, wherein the one of the conical spring washer and the domed spring washer and the one of the another conical spring washer and the another domed spring washer are arranged consecutively in an axial direction so that respective convex sides thereof face one another.

11. The fuel injection valve of claim 8, further comprising a connecting strap, wherein the one of the conical spring washer and the domed spring washer and the one of the another conical spring washer and the another domed spring washer are interconnected by the connecting strap.

12. A fuel injection valve for a fuel injection system of an internal combustion engine, the fuel injection valve comprising:

a resetting spring;

a valve closing member; a magnetic coil;

an armature loadable by the magnetic coil against the resetting spring in a;

lifting direction;

a valve needle connected to the valve closing member, wherein the armature is movable between a first stop, connected to the valve needle and limiting a movement of the armature in the lifting direction, and a second stop, connected to the valve needle and limiting another movement of the armature against the lifting direction, wherein the second stop is formed by an end face of a stop member opposite the armature;

another end face of the armature opposite the second stop and the end face of the stop member opposite the armature each include a flat section; and a damping spring between the second stop and the armature, wherein the damping spring includes a cup spring surrounding the valve needle in a ring shape, wherein the cup spring includes one of a conical spring washer and a domed spring washer; and the cup spring includes one of another conical spring washer and another domed spring washer, wherein the one of the conical spring washer and the domed spring washer and the one of the another conical spring washer and the another domed spring washer are arranged consecutively in an axial direction so that respective convex sides thereof face one another.

13. A fuel injection valve for a fuel injection system of an internal combustion engine, the fuel injection valve comprising:

a resetting spring;

a valve closing member; a magnetic coil;

an armature loadable by the magnetic coil against the resetting spring in a;

lifting direction;

a valve needle connected to the valve closing member, wherein the armature is movable between a first stop, connected to the valve needle and limiting a movement of the armature in the lifting direction, and a second stop, connected to the valve needle and limiting another movement of the armature against the lifting direction, wherein the second stop is formed by an end face of a stop member opposite the armature;

another end face of the armature opposite the second stop and the end face of the stop member opposite the armature each include a flat section; and a damping spring between the second stop and the armature, wherein the damping spring includes a cup spring surrounding the valve needle in a ring shape, wherein the cup spring includes one of a conical spring washer and a domed spring washer;

the cup spring includes one of another conical spring washer and another domed spring washer; and a connecting strap, wherein the one of the conical spring washer and the domed spring washer and the one of the another conical spring washer and the another domed spring washer are interconnected by the connecting strap.

* * * * *

UNITED STATES PATENT AND TRADEMARK OFFICE

CERTIFICATE OF CORRECTION

PATENT NO. : 6,367,769 B1
DATED : April 9, 2002
INVENTOR(S) : Ferdinand Reiter

It is certified that error appears in the above-identified patent and that said Letters Patent is hereby corrected as shown below:

Column 1,
Line 53, change “maybe” to -- may be --.

Column 2,
Line 4, change “have widely” to -- have been widely --.
Line 8, change “on” to -- an --.

Column 5,
Line 62, delete “;” after “a”.

Column 7,
Line 2, change “in a;” to -- in a lifting direction --.
Line 3, delete “lifting direction;”

Column 8,
Line 3, delete “;” after “a”.

Signed and Sealed this

Seventeenth Day of June, 2003

JAMES E. ROGAN
*Director of the United States Patent and Trademark Office*